US006296547B1

(12) United States Patent
Pruet et al.

(10) Patent No.: US 6,296,547 B1
(45) Date of Patent: Oct. 2, 2001

(54) METHOD AND SYSTEM FOR MANUFACTURING A PHOTOCATHODE

(75) Inventors: James D. Pruet, Garland; David G. Couch, Kaufman, both of TX (US)

(73) Assignee: Litton Systems, Inc., Woodland Hills, CA (US)

( * ) Notice: Subject to any disclaimer, the term of this patent is extended or adjusted under 35 U.S.C. 154(b) by 0 days.

(21) Appl. No.: 09/440,753

(22) Filed: Nov. 16, 1999

(51) Int. Cl.[7] ..... B24B 49/00

(52) U.S. Cl. ..... 451/5; 451/41; 451/56; 451/444; 451/285

(58) Field of Search ..... 451/5, 41, 56, 451/444, 283–289

(56) References Cited

U.S. PATENT DOCUMENTS 5,291,693 * 3/1994 Nguyen ..... 451/444
5,456,627 * 10/1995 Jackson et al. ..... 451/56
5,578,529 * 11/1996 Mullins ..... 451/41
5,725,417 * 3/1998 Robinson ..... 451/56
5,779,522 * 7/1998 Walker et al. ..... 451/56
5,857,898 * 1/1999 Hiyama et al. ..... 451/56
5,879,266 * 3/1999 Robinson ..... 451/56
5,916,010 * 6/1999 Varian et al. ..... 451/56
5,954,888 * 9/1999 Gupta et al. ..... 134/3
5,957,750 * 9/1999 Brunelli ..... 451/56
6,139,406 * 10/2000 Kennedy et al. ..... 451/444
6,149,508 * 11/2000 Vanell et al. ..... 451/56

* cited by examiner

*Primary Examiner*—M. Rachuba
(74) *Attorney, Agent, or Firm*—Baker Botts L.L.P.

(57) ABSTRACT

A system (10) for manufacturing a photocathode includes a support (12) and a polishing pad (14) disposed adjacent the support (12). The polishing pad (14) is operable to polish the photocathode in response to movable contact of the photocathode relative to the polishing pad (14). The system (10) also includes a rinsing system (16) coupled to the support (12). The rinsing system (16) is operable to deliver a rinsing agent to the polishing pad (14). The system (10) further includes a control system (62) operable to automatically regulate delivery of the rinsing agent to the rinsing system (16) at a predetermined time period.

23 Claims, 2 Drawing Sheets

METHOD AND SYSTEM FOR MANUFACTURING A PHOTOCATHODE

TECHNICAL FIELD OF THE INVENTION

This invention relates in general to the field of electro-optics and, more particularly, to a method and system for manufacturing a photocathode.

BACKGROUND OF THE INVENTION

There are numerous methods and systems for detecting radiation. In one type of detector, photocathodes are used in conjunction with microchannel plates (MCPs) to detect low levels of electromagnetic radiation. Photocathodes emit electrons in response to exposure to photons. The electrons may then be accelerated by electrostatic fields toward a microchannel plate. A microchannel plate is typically manufactured from lead glass and has a multitude of channels, each one operable to produce cascades of secondary electrons in response to incident electrons. A receiving device then receives the secondary electrons and sends out a signal responsive to the electrons. Since the number of electrons emitted from the microchannel plate is much larger than the number of incident electrons, the signal produced by the device is stronger than it would have been without the microchannel plate.

One example of the use of a photocathode with a microchannel plate is an image intensifier tube. The image intensifier tube is used in night vision devices to amplify low light levels so that the user can see even in very dark conditions. In the image intensifier tube, a photocathode produces electrons in response to photons from an image. The electrons are then accelerated to the microchannel plate, which produces secondary emission electrons in response. The secondary emission electrons are received at a phosphor screen or, alternatively, a charge coupled device (CCD), thus producing a representation of the original image.

Another example of a device that uses a photocathode with a microchannel plate is a scintillation counter used to detect particles. High-energy particles pass through a scintillating material, thereby generating photons. Depending on the type of material used and the energy of the particles, these photons can be small in number. A photocathode in conjunction with a microchannel plate can be used to amplify the photon signal in similar fashion to an image intensifier tube. The detector can thus be used to detect faint particle signals and to transmit a signal to a device, e.g., a counter, that records the particle's presence.

A photocathode may include one or more layers of material deposited or grown on a surface or substrate of the photocathode to provide anti-reflection properties, filtering properties, electron transportability properties, and other suitable properties associated with the photocathode. After the layers have been deposited or grown on the surface of the photocathode, the surface of the photocathode generally requires polishing to reduce the layer to a predetermined thickness to provide the desired photocathode properties. The polishing process generally includes translating the photocathode across a polishing pad and/or polishing compound for a predetermined amount of time. Thus, the amount of material removal from the photocathode is a function of the abrasive characteristics of the polishing pad and/or chemical etching properties of the polishing compound, the amount of pressure applied to the photocathode during polishing, and the amount of time the photocathode is polished.

Various types of processes may be used to polish the photocathode. An example polishing process may include applying a polishing compound to a polishing pad and translating the photocathode across the polishing pad and polishing compound for a predetermined period of time. After the predetermined time period has elapsed, the photocathode may be removed from the polishing compound and transported to a rinsing station where excess polishing compound may be removed from the photocathode.

However, prior systems and methods for manufacturing a photocathode suffer several disadvantages. For example, chemical properties of the polishing compound may cause oxidation of the photocathode as the photocathode is removed from the polishing pad. As a result of the oxidation, the photocathode may require additional processing to remove the oxidation or the photocathode may be unsuitable for various applications.

SUMMARY OF THE INVENTION

Accordingly, a need has arisen for a better technique having greater flexibility and adaptability for manufacturing a photocathode. In accordance with the present invention, a system and method for manufacturing a photocathode is provided that substantially eliminates or reduces disadvantages and problems associated with previously developed systems and methods.

According to one embodiment of the present invention, a system for manufacturing a photocathode comprises a support and a polishing pad disposed adjacent the support. The polishing pad is operable to polish the photocathode in response to movable contact of the photocathode relative to the polishing pad. The system also comprises a rinsing system coupled to the support. The rinsing system is operable to deliver a rinsing agent to the polishing pad. The system further includes a controller. The controller is operable to deliver the rinsing agent to the rinsing system at a predetermined time period.

According to another embodiment of the present invention, a method for manufacturing a photocathode comprises positioning a polishing pad on a support and disposing a rinsing system adjacent the polishing pad. The method also comprises polishing the photocathode with the polishing pad by movable contact of the photocathode relative to the polishing pad. The method also comprises transferring a rinsing agent to the polishing pad via the rinsing system at a predetermined time period. The method further comprises rinsing the photocathode with the rinsing agent prior to removing the photocathode from contact with the polishing pad.

The technical advantages of the present invention include providing a system and method for manufacturing a photocathode that provides greater uniformity and consistency of photocathodes. For example, according to one aspect of the present invention, a rinsing system automatically delivers a rinsing agent to the photocathode after the photocathode has been polished for a predetermined time period. The rinsing agent is delivered to the photocathode such that the photocathode may be rinsed prior to removal of the photocathode from the polishing pad. Thus, chemicals that may cause oxidation of the photocathode are substantially removed from the photocathode prior to removing the photocathode from the polishing pad.

Other technical advantages of the present invention will be readily apparent to one skilled in the art from the following figures, descriptions, and claims.

BRIEF DESCRIPTION OF THE DRAWINGS

For a more complete understanding of the present invention, and the advantages thereof, reference is now made to the following descriptions taken in connection with the accompanying drawings, in which.

DETAILED DESCRIPTION OF THE DRAWINGS

Embodiments of the present invention and the advantages thereof are best understood by referring to the following description and drawings, wherein like numerals are used for like and corresponding parts of the various drawings.

Figure 1:
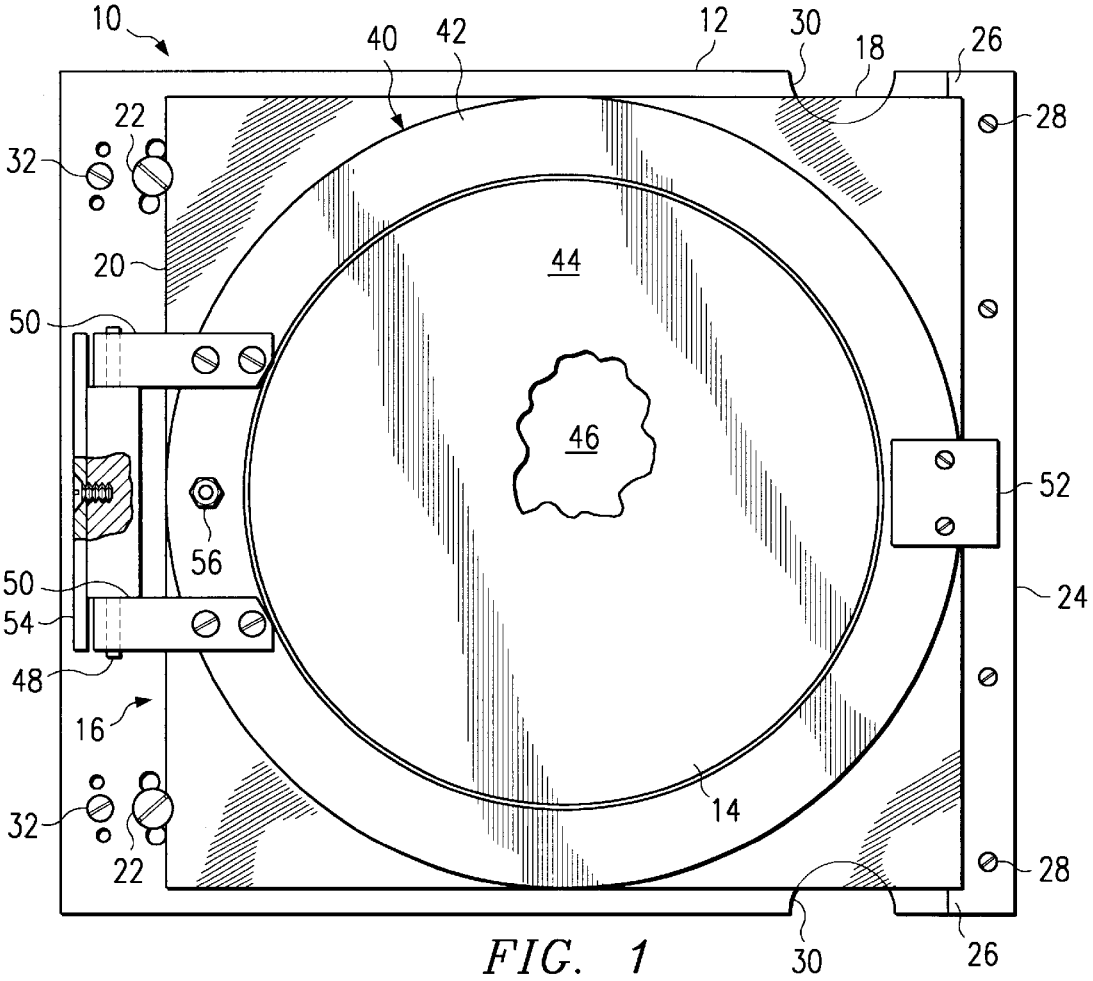
FIG. 1 is a diagram illustrating a system for manufacturing a photocathode in accordance with an embodiment of the present invention.
Figure 2:
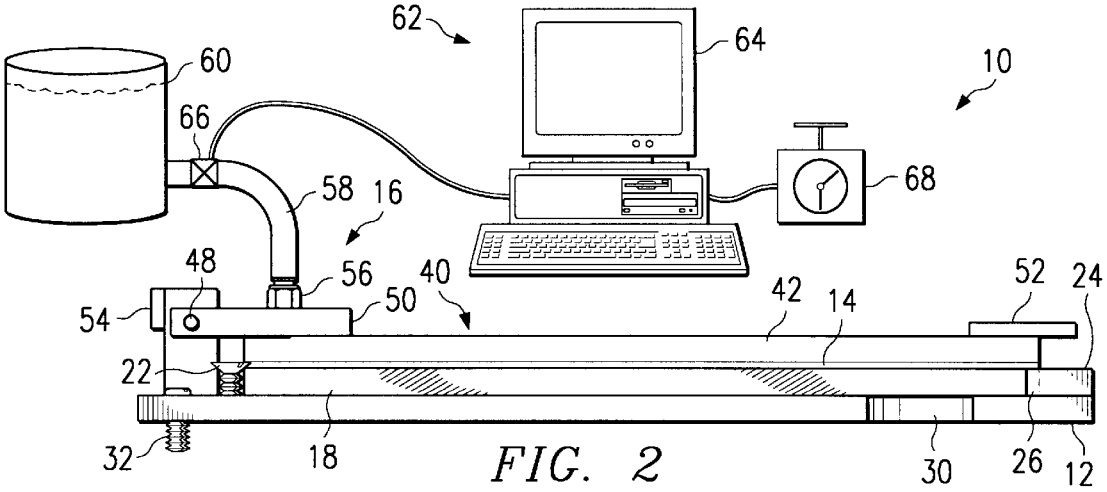
FIG. 2 is a diagram of a side view of the system illustrated in FIG. 1.

FIG. 1 is a diagram illustrating a system 10 for manufacturing a photocathode (not explicitly shown) in accordance with an embodiment of the present invention, and FIG. 2 is a diagram illustrating a side view of system 10 illustrated in FIG. 1. System 10 comprises a support 12, a polishing pad 14, and a rinsing system 16. Briefly, the photocathode may be placed in contact with polishing pad 14 and translated across polishing pad 14 to abrade and/or polish a surface of the photocathode. Polishing pad 14 may be constructed from various materials having abrasive characteristics to obtain a required surface finish of the polished photocathode. Once the photocathode has been polished using polishing pad 14, rinsing system 16 may be used to deliver a rinsing agent to polishing pad 14 and the photocathode to remove any unwanted material from the photocathode prior to removal of the photocathode from system 10.

In the embodiment illustrated in FIGS. 1 and 2, system 10 also comprises a polishing base 18 disposed between support 12 and polishing pad 14 to provide a substantially planar polishing surface for polishing the photocathode. For example, polishing base 18 may be constructed from glass or other suitable materials to provide a smooth and substantially planar polishing surface. Polishing base 18 may be secured to support 12 by positioning an edge 20 of polishing base 18 against fasteners 22 coupled to support 12. Fasteners 22 may be constructed from nylon or other suitable materials to prevent scratching or chipping of polishing base 18. A cleat 24 may be secured to support 12 at an end of support 12 opposite fasteners 22 to prevent longitudinal movement of polishing base 18 during a polishing operation. Cleat 24 may include longitudinally directed extensions 26 located on each end of cleat 24 to prevent lateral movement of polishing base 18 during a polishing operation. Cleat 24 may also be constructed from nylon or other suitable materials to prevent scratching or damage to polishing base 18, and cleat 24 may be secured to support 12 using fasteners 28. However, other suitable methods and devices may be used to secure polishing base 18 to support 12 to prevent movement of polishing base 18 during a polishing operation.

Additionally, support 12 may be configured having laterally and oppositely disposed recesses 30 to facilitate removal and replacement of polishing base 18. Support 12 may also include fasteners 32 for securing support 12 to another substructure. Thus, system 10 may be transported from one location to another and secured to the substructure using fasteners 32, thereby providing a portable system 10 for polishing a photocathode.

Rinsing system 16 comprises a rinsing element 40 for delivering a rinsing agent to polishing pad 14. In the embodiment illustrated in FIG. 1, rinsing element 40 comprises a rinsing ring 42 having a generally circular configuration. However, rinsing element 40 may include other suitable shapes and configurations for delivering a rinsing agent to polishing pad 14. As illustrated in FIG. 1, rinsing ring 42 defines an interior area 44 of polishing pad 14 for polishing the photocathode. For example, a polishing compound 46 may be applied to interior area 44 of polishing pad 14 for polishing the photocathode. Polishing compound 46 may include chemical and/or abrasive characteristics for polishing the photocathode. Thus, rinsing ring 42 may also be used to retain polishing compound 46 within interior area 44 of polishing pad 14 during a polishing operation.

In the embodiment illustrated in FIGS. 1 and 2, rinsing element 40 is rotatably coupled to support 12 to provide upwardly and downwardly rotational movement of rinsing element 40 relative to support 12. For example, rinsing element 40 may be coupled to a hinge 48 via hinge supports 50. However, other suitable methods or devices may be used to secure rinsing element 40 to support 12. Thus, in operation, a handle 52 attached to rinsing element 40 may be used to rotate rinsing element 40 upwardly and downwardly relative to support 12 to accommodate removal and replacement of polishing base 18 and polishing pad 14. Additionally, rotating rinsing element 40 upwardly away from support 12 accommodates cleaning and/or removal of polishing compound 46 from polishing pad 14 in preparation for additional polishing operations. Hinge 48 may also include a hinge stop 54 to prevent over-rotation of rinsing element 40 and to accommodate easier manipulation of rinsing element 40 by an operator of system 10.

Rinsing system 16 also comprises a supply line connection 56 coupled to rinsing element 40 for connecting rinsing element 40 to a rinsing agent supply line 58. Supply line 58 may be coupled to a rinsing agent supply 60 for transporting the rinsing agent to rinsing element 40. The rinsing agent may include water or other suitable materials for rinsing the photocathode after the polishing operation. Supply line 58 may be constructed from a flexible hose or tube to accommodate movement of rinsing element 40 relative to support 12. However, supply line 58 may be constructed from other suitable materials for transferring the rinsing agent from rinsing agent supply 60 to rinsing element 40.

System 10 may also comprise a control system 62 to control the delivery of the rinsing agent to rinsing element 40. Control system 62 may comprise a computer, workstation, mini-computer, or other suitable processing device 64 for regulating the delivery of the rinsing agent to rinsing element 40. For example, control system 62 may also comprise a solenoid valve 66 and a timing device 68 coupled to processing device 64. Solenoid valve 66 may be coupled to rinsing agent supply line 58 to regulate the delivery of the rinsing agent to rinsing element 40 in response to signals received from processing device 64.

In operation, an operator may position polishing base 18 and polishing pad 14 on support 12 in preparation for a polishing operation. Polishing compound 46 may also be applied to interior area 44 of polishing pad 14 to facilitate polishing of a photocathode using system 10. Once polishing base 18 and polishing pad 14 are positioned on support 12, rinsing element 40 may be rotated downwardly toward support 12 by rotating rinsing element 40 about hinge 48. The operator may activate timing device 68 at the beginning of the polishing operation to limit the polishing operation to a predetermined period of time. For example, the amount of material removal during a polishing process is generally a factor of the abrasive and/or chemical properties of polishing pad 14 and polishing compound 46, the amount of time the photocathode is in contact with, and translated relative to, polishing pad 14 and polishing compound 46, and the amount of pressure applied to the photocathode relative to polishing pad 14 during the polishing operation. Thus, the operator may activate timing device 68 to regulate the amount of time the photocathode is polished using system 10.

After the predetermined period of time elapses, timing device 68 may automatically transmit a signal to processing device 64 to activate solenoid valve 66, thereby automatically delivering the rinsing agent to rinsing element 40. The rinsing agent is delivered from rinsing element 40 to interior area 44 of polishing pad 14 for rinsing the photocathode prior to removal of the photocathode from contact with polishing pad 14 and polishing compound 46. For example, the surface tension of the rinsing agent generally causes polishing compound 46 and any other unwanted material resulting from the polishing operation to be removed from the photocathode as the photocathode is removed from contact with polishing pad 14 and polishing compound 46. Thus, oxidation of the photocathode that may result from material adhering to the photocathode is substantially eliminated by substantially removing material adhering to the photocathode prior to removing the photocathode from system 10.

Figure 3:
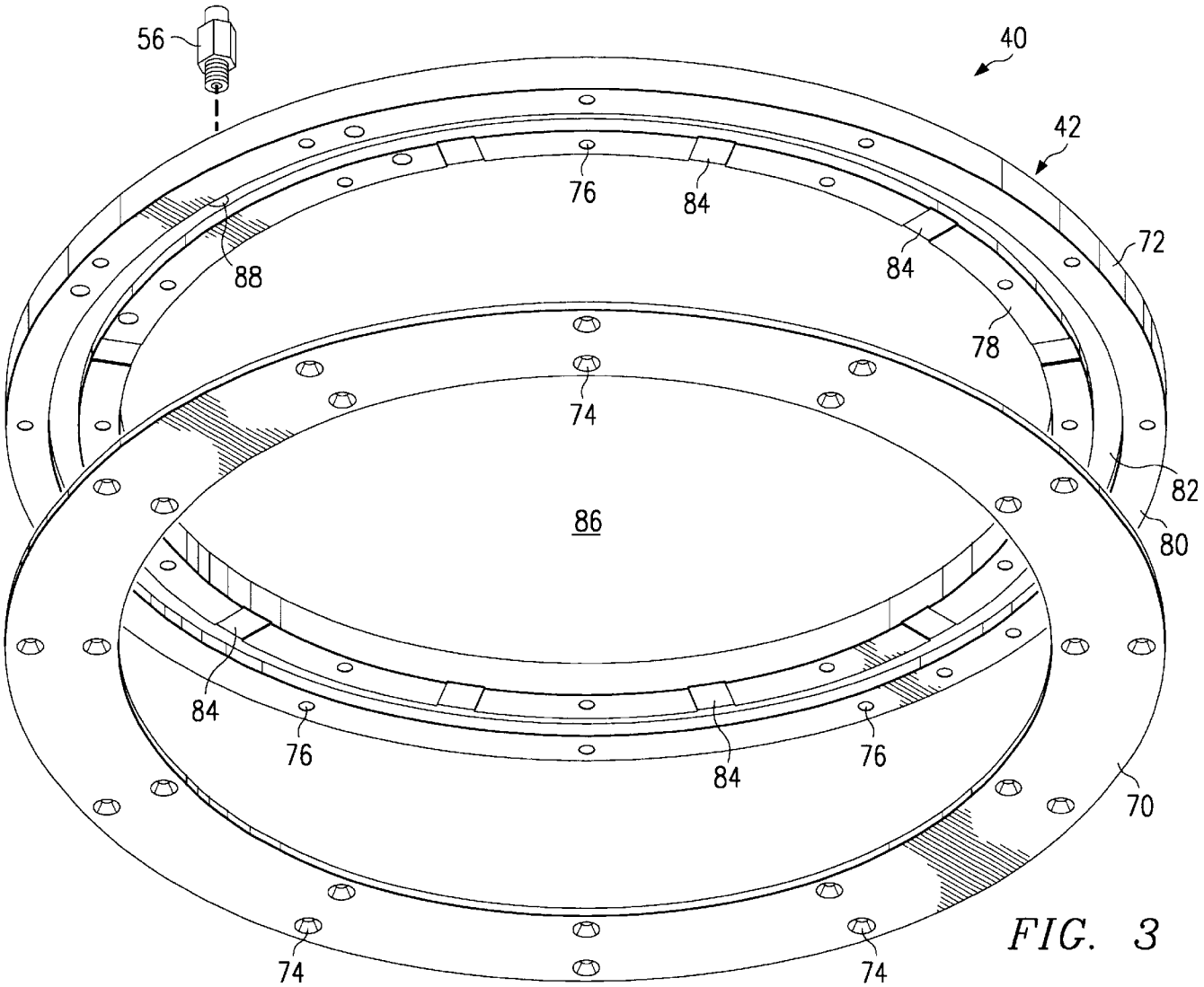
FIG. 3 is an exploded assembly section diagram illustrating a rinsing element of the system in accordance with an embodiment of the present invention.

FIG. 3 is an exploded assembly diagram illustrating rinsing element 40 in accordance with an embodiment of the present invention. As described above, in this embodiment, rinsing element 40 comprises rinsing ring 42 having a generally circular configuration. Rinsing ring 42 comprises a base 70 and a cover 72. Base 70 may be removably coupled to cover 72 by aligning openings 74 in base 70 with corresponding openings 76 in cover 72 and inserting fasteners (not explicitly shown) through openings 74 and 76. However, other suitable methods or devices may be used to removably couple base 70 to cover 72.

Cover 72 comprises an internal wall 78 and an external wall 80 extending circumferentially about cover 72. Internal wall 78 is spaced apart from external wall 80, thereby forming a channel 82 disposed between internal wall 78 and external wall 80 extending circumferentially about cover 72. Internal wall 78 comprises a plurality of radially spaced apart passages 84 connected to channel 82 and extending inwardly toward an interior area 86 of cover 72. Cover 72 also comprises a passage 88 disposed within channel 82 and extending to supply line connection 56.

In operation, the rinsing agent is transferred through supply line 58, through passage 88, and into channel 82 of cover 72. As described above, base 70 is releasably coupled to cover 72 to retain the rinsing agent within channel 82. For example, a sealing compound or gasket (not explicitly shown) may be disposed between base 70 and cover 72 to prevent leakage of the rinsing agent from between base 70 and cover 72. However, other suitable devices or methods may be used to prevent leakage of the rinsing agent from between base 70 and cover 72. The rinsing agent enters channel 82 and travels circumferentially about cover 72 within channel 82 and passes through passages 84 to internal area 86 of cover 72, internal area 86 corresponding with interior area 44 of polishing pad 14 as illustrated in FIG. 1. Thus, the rinsing agent is substantially uniformly distributed to interior area 86 to provide rinsing of the photocathode prior to removal of the photocathode from contact with polishing compound 46 and/or polishing pad 14.

Thus, the present invention provides greater efficiency than prior systems by combining polishing and rinsing operations in a single system 10. Additionally, the present invention provides greater photocathode integrity-than prior systems by substantially preventing oxidation of the photocathode upon completion of the polishing operation.

Although the present invention and its advantages have been described in detail, it should be understood that various changes, substitutions and alterations can be made without departing from the spirit and scope of the present invention as defined by the appended claims.

What is claimed is:

1. A system for manufacturing a photocathode, comprising:

a support;

a polishing pad disposed adjacent the support, the polishing pad operable to polish the photocathode in response to movable contact of the photocathode relative to the polishing pad;

a rinsing system coupled to the support and operable to retain a polishing compound on the polishing pad during polishing of the photocathode, the rinsing system further operable to uniformly deliver a rinsing agent to the polishing pad; and a control system operable to automatically regulate the delivery of the rinsing agent to the rinsing system at a predetermined time period.

2. The system of claim 1, further comprising a polishing base disposed between the polishing pad and the support, the polishing base operable to provide a substantially planar polishing surface to polish the photocathode.

3. The system of claim 1, wherein the rinsing system comprises:

a base; and a cover removably coupled to the base, the cover having a channel and a plurality of passages coupled to the channel, the channel and passages operable to deliver the rinsing agent to the polishing pad.

4. The system of claim 3, wherein the base and the cover are rotatably coupled to the support.

5. The system of claim 1, wherein the rinsing system comprises a rinsing ring having a substantially circular configuration, the rinsing ring having a plurality of spaced apart passages directed inwardly toward the polishing pad to direct the rinsing agent to the polishing pad.

6. The system of claim 1, wherein the control system comprises a timing device operable to monitor the predetermined time period.

7. The system of claim 1, wherein the rinsing system comprises:

a base; and a cover having a channel disposed between a first wall and a second wall, the first wall having a plurality of spaced apart passages connected to the channel, the passages operable to deliver the rinsing agent from the channel to the polishing pad.

8. The system of claim 1, wherein the rinsing system comprises a rinsing element, the rinsing element disposed about a periphery of the polishing pad and operable to retain the polishing compound on the polishing pad during polishing of the photocathode.

9. A method for manufacturing a photocathode comprising:

positioning a polishing pad on a support;

disposing a rinsing system adjacent the polishing pad;

providing a polishing compound to the polishing pad, the rinsing system operable to retain the polishing compound on the polishing pad;

polishing the photocathode with the polishing pad and the polishing compound by movable contact of the photocathode relative to the polishing pad and the polishing compound;

automatically and uniformly distributing a rinsing agent to the polishing pad via the rinsing system at a predetermined time period; and rinsing the photocathode with the rinsing agent prior to removing the photocathode from contact with the polishing pad and the polishing compound.

10. The method of claim 9, wherein distributing the rinsing agent comprises:

directing the rinsing agent into a channel of a rinsing element; and transferring the rinsing agent from the channel to the polishing pad via a plurality of spaced apart passages of the rinsing element connected to the channel.

11. The method of claim 9, wherein disposing the rinsing system adjacent the polishing pad comprises rotating a rinsing element downwardly toward the polishing pad, the rinsing element rotatably coupled to the support.

12. The method of claim 9, further comprising activating a timing device coupled to the rinsing system to monitor the predetermined time period.

13. The method of claim 9, further comprising disposing a polishing base between the polishing pad and the support to provide a substantially planar polishing surface to polish the photocathode.

14. The method of claim 9, wherein distributing the rinsing agent comprises:

directing the rinsing agent to a rinsing ring of the rinsing system, the rinsing ring having a substantially circular configuration, wherein a portion of the polishing pad is disposed within an interior area of the rinsing ring; and transferring the rinsing agent through a plurality of passages of the rinsing ring, the passages directed inwardly toward the interior area of the rinsing ring.

15. The method of claim 9, wherein disposing the rinsing system comprises disposing a rinsing element about a periphery of the polishing pad.

16. A method for manufacturing a photocathode comprising:

positioning a polishing pad on a support;

disposing a rinsing element adjacent the polishing pad, the rinsing element comprising a plurality of passages operable to uniformly distribute a rinsing agent to the polishing pad;

providing a polishing compound to the polishing pad;

polishing the photocathode with the polishing pad and the polishing compound by movable contact of the photocathode relative to the polishing pad and the polishing compound;

delivering a rinsing agent to the polishing pad via the passages of the rinsing element; and rinsing the photocathode with the rinsing agent as the photocathode is removed from the polishing pad, wherein a surface tension of the rinsing agent removes the polishing compound from a polishing surface of the photocathode prior to exposure of the polishing surface of the photocathode to an oxidating environment.

17. The method of claim 16, wherein disposing the rinsing element comprises disposing the rinsing element about a periphery of the polishing pad.

18. The method of claim 16, wherein disposing the rinsing element comprises disposing the rinsing element adjacent the polishing pad, the rinsing element operable to retain the polishing compound on the polishing pad during polishing.

19. The method of claim 16, flirter comprising providing a controller operable to initiate delivery of the rinsing agent from the rinsing element after a predetermined polishing time period.

20. The method of claim 16, wherein providing the rinsing element comprises providing a rinsing ring disposed about a periphery of the polishing pad, the rinsing ring operable to retain the polishing compound on the polishing pad during polishing of the photocathode.

21. The method of claim 20, wherein providing the rinsing ring comprises providing the rinsing ring having a channel disposed in fluid communication with the passages and operable to distribute the rinsing agent to the passages.

22. The method of claim 16, further comprising:

providing a timing device configured to be activated upon initiating polishing of the photocathode; and providing a controller coupled to the timing device and operable to automatically initiate delivery of the rinsing agent by the rinsing element after a predetermined time period.

23. The method of claim 16, wherein providing the rinsing element comprises providing the rinsing element disposed adjacent the polishing pad, the rinsing element operable to retain the rinsing agent on the polishing pad.

* * * * *